US008088085B2

(12) United States Patent
Thiebaut et al.

(10) Patent No.: US 8,088,085 B2
(45) **Date of Patent: *Jan. 3, 2012**

(54) MASSAGING AND/OR DISPENSING DEVICE

(75) Inventors: Laure Thiebaut, Clichy (FR); Philippe Bonneyrat, Herblay (FR)

(73) Assignee: L'Oreal, Paris (FR)

( * ) Notice: Subject to any disclaimer, the term of this patent is extended or adjusted under 35 U.S.C. 154(b) by 1288 days.

This patent is subject to a terminal disclaimer.

(21) Appl. No.: 11/446,297

(22) Filed: Jun. 5, 2006

(65) Prior Publication Data

US 2006/0276731 A1 Dec. 7, 2006

Related U.S. Application Data

(60) Provisional application No. 60/689,547, filed on Jun. 13, 2005.

(30) Foreign Application Priority Data

Jun. 3, 2005 (FR) ..... 05 51493

(51) Int. Cl.
*A61H 1/00* (2006.01)

(52) U.S. Cl. ..... 601/17; 601/112; 601/135; 601/137

(58) Field of Classification Search ..... 601/15, 601/17, 18, 112, 113, 114, 136–138; 15/22.1, 15/24, 29, 31, 97.1

See application file for complete search history.

(56) References Cited

U.S. PATENT DOCUMENTS

| | | | | |
|---|---|---|---|---|
| 3,932,909 | A | 1/1976 | Johnson et al. | |
| 3,981,597 | A | 9/1976 | Cohn | |
| 3,994,290 | A | 11/1976 | Springer et al. | |
| 4,189,801 | A * | 2/1980 | Lanusse | 15/22.1 |
| 4,492,223 | A | 1/1985 | Burke | |
| 5,725,483 | A | 3/1998 | Podolsky | |
| 6,170,108 | B1 * | 1/2001 | Knight | 601/17 |

FOREIGN PATENT DOCUMENTS

| | | |
|---|---|---|
| EP | 0 216 038 A2 | 4/1987 |
| EP | 1 593 363 | 11/2005 |
| FR | 2 674 183 | 9/1992 |
| FR | 2 811 872 | 1/2002 |
| FR | 2 841 159 | 12/2003 |
| WO | 94/04116 | 3/1994 |

OTHER PUBLICATIONS

U.S. Appl. No. 11/944,509, filed Nov. 23, 2007, Bonneyrat.
U.S. Appl. No. 11/446,121, filed Jun. 5, 2006, Thiebaut, et al.

* cited by examiner

*Primary Examiner* — Quang D Thanh
(74) *Attorney, Agent, or Firm* — Oblon, Spivak, McClelland, Maier & Neustadt, L.L.P.

(57) ABSTRACT

An appliance or device for massaging and/or dispensing a product. A preferred example includes a container holding the product, preferably a cosmetic product, a housing to which the container is mounted, and a massage element mounted on this housing. A rotary driving arrangement drives the massage element about an axis of rotation of the massaging element relative to the housing. A conduit is in fluid communication between an outlet from the container and the massage element. The container is configured for the packaging and dispensing of the product under pressure, with the conduit being connected to an outlet of a dispensing valve on the container.

45 Claims, 6 Drawing Sheets

-1-

MASSAGING AND/OR DISPENSING DEVICE

CROSS-REFERENCE TO RELATED APPLICATIONS

This document claims priority to French Application Number 05 51493, filed Jun. 3, 2005 and U.S. Provisional Application No. 60/689,547, filed Jun. 13, 2005, the entire contents of which are hereby incorporated by reference.

FIELD OF THE INVENTION

The invention provides an appliance or device for massaging and/or dispensing a cosmetic product held in a container mounted on a housing of the appliance. Preferably, the massaging action is obtained by causing the massaging element of this appliance to rotate.

BACKGROUND OF THE INVENTION

Discussion of Background

The expression "cosmetic product" is understood to mean a product as defined in EC Council Directive 93/35/CEE dated 14 Jun. 1993.

U.S. Pat. No. 3,994,290 describes a known massage device that includes a rotary massage unit which rotates by a motor and which carries a plurality of balls mounted freely thereon. The massage device is mounted on a housing also accommodating a container holding a product capable of being distributed to the balls via a channel. The container includes a one-way duck-bill valve which can only be caused to open in response to a partial vacuum created in a chamber in the housing attached to this valve. Such a partial vacuum can be obtained in the chamber by virtue of the relative size and shape of the chamber and the channel in communication therewith, when the container returns from a partially depressed position in the chamber to its initial position.

U.S. Pat. No. 3,932,909 describes a device for cleansing the skin. The device includes a handle containing a product to be applied and a rotary applicator in the form of a brush attached to the end of the handle. The brush is supplied with product via a conduit which communicates with the inside of the handle and into which the product flows by gravity. The conduit emerges via several openings distributed over the entire surface of the brush. To cause the brush to rotate, a spring mounted behind the brush is compressed by pulling a cord, and the spring causes the brush to rotate as it unwinds. When the spring is fully unwound the brush stops rotating, so that if the application is not completed, it is necessary to pull the cord again.

A problem posed by the massage devices in the current art lies in the fact that they are not easy to grasp, nor is it easy to selectively dispense the product or control the rotation of the massaging element.

Another problem posed by the massage devices of the current art lies in the fact that they fail to provide reliable and easy-to-use solutions for dispensing a product simultaneously with or independently of the massaging action. Moreover, with the devices of the current art the dispensing of the product is uncertain or inconsistent when the container is no longer completely full.

SUMMARY OF THE INVENTION

It is an object of the invention to provide an appliance or device for massaging and/or dispensing a product. According to a preferred example, the device includes a container holding the product, preferably a cosmetic product, and a housing upon which the container is mounted. A massage element is mounted on the housing, and a rotary driving arrangement provides rotation about an axis of rotation of the massage element relative to the housing. In addition, a conduit is in fluid communication between an outlet from the container and the massage element. Further, the container is configured for the packaging and dispensing of a product under pressure, with the conduit being connected to an outlet of a dispensing valve on the container.

By way of example, the container can be arranged relative to the housing so as to form a grasping element for the appliance. A closed bottom of the container, opposite the dispensing valve, can then form a grasping element.

According to one example, an actuating element of the valve can project beyond the external outline of the housing. This actuating element can include a lever arm. For example, actuation of the valve can be obtained by pushing down the valve stem. Alternatively and/or in addition, and also by way of example, actuation of the valve can be obtained by inclining or tilting the valve stem.

For example, the conduit can include a section parallel to the axis of rotation, and in particular a section having an axis substantially coincident with the axis of rotation. As the massaging element rotates, this conduit section remains fixed which limits problems of dynamic sealing. Also by way of example, this section can be connected to a second section forming an angle relative to the first section, with this second section being connected to the valve.

A principal lengthwise axis of the container can form an angle with the axis of rotation of the massaging element. Alternatively, the container can include a principal lengthwise axis parallel to the axis of rotation of the massaging element.

For example, the container can be mounted on the housing at a first end axially opposite, relative to the axis of rotation of the massaging element, a second end of the housing on which the massaging element is held, so that the container includes an axis extending between the outlet and a bottom of the container, with this axis being parallel to the axis of rotation.

Advantageously, according to an example, the container can be detachably mounted on the housing. The container can be held in place by snapping into a cavity of the housing, for example.

The container can include a wall delineating therein a compartment containing a product to be sprayed and a gas under pressure at least partially mixed together.

Alternatively, the container can include two compartments, for example having a variable volume, with a first compartment in communication with the valve and containing the product to be sprayed and a second compartment containing a propellant, and with the wall being impermeable to the product and to the propellant.

Advantageously, the massage element can be detachably mounted on the housing. The massaging element can present an application surface having at least one projection, for example an off-center projection, or a plurality of projections of different shapes and different heights.

The massaging element can include a detachable head presenting the application surface. The user can thus obtain different applications in relation to the chosen massage element. For example, the massage element can include a foam pad when the massage is intended to produce a contouring effect for example, or a tuft of bristles when the massage is intended for example to spread shaving foam, or to cleanse the skin, or an abrasive application surface, for example obtained by incorporating particles of aluminium oxide in a resin or foam, when micro-dermabrasion of the outer layers of the epidermis or "peeling" is wanted.

As a further example, the massage element can include a structure holding freely rotatable balls seated in recesses in the massaging element.

The massage element can include a resiliently deformable portion, for example made of a closed-cell foam or an elastomer material to accommodate the surface differences of the areas of the body to be massaged.

The application surface of the massage element can present a symmetry of revolution substantially about an axis of symmetry, with the application surface being caused to rotate by the driving arrangement about the axis of symmetry.

The driving arrangement can include a motor powered for example by a battery, for example a cell accommodated in the housing, or by another power source (for example by a power source external to the housing using a cord and plug to connect the device to an electrical outlet). The motor can be operated by a control device. The motor can rotatably drive the applicator element directly or indirectly, for example via transmission elements, so as to reduce the speed of rotation and increase the torque for example.

According to another object or aspect of the invention a massaging element is provided which is designed to be rotatably and detachably mounted on a housing of an appliance or device according to the invention.

A further object or aspect of the invention provides a kit or assembly including an appliance according to the invention and a plurality of containers, with the containers being arranged or designed to be selectively and detachably mounted on the housing of the appliance. In such a kit, the containers preferably hold different products.

For example, the kit can include a plurality of massage elements, which can be selectively and detachably mounted on the housing. Thus, for example depending on the desired massaging effect, the user selects the massaging element having the appropriate surface or surface projections to obtain this massaging effect. In such a kit or assembly, the massage elements preferably have different surfaces and/or surface projections.

The invention also provides a cosmetic and non-therapeutic method of applying a product on a surface of the body. A preferred example of the method includes providing a kit as discussed above, selecting a container, and mounting the selected container on the appliance housing. A product is applied onto the body, and the area of the body onto which the product has been applied is massaged with the massaging element driven in rotation.

According to the preferred example of the method, the user preferably selects a massaging element to mount on the appliance housing in relation to the container selected and/or the desired massaging effect.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood by reading the following description and by reference to the accompanying figures illustrating examples of embodiments of the invention. The examples are provided for guidance only and are in no way limitative of the invention. In the drawings.

DETAILED DESCRIPTION OF THE PREFERRED EMBODIMENTS

Figure 1:
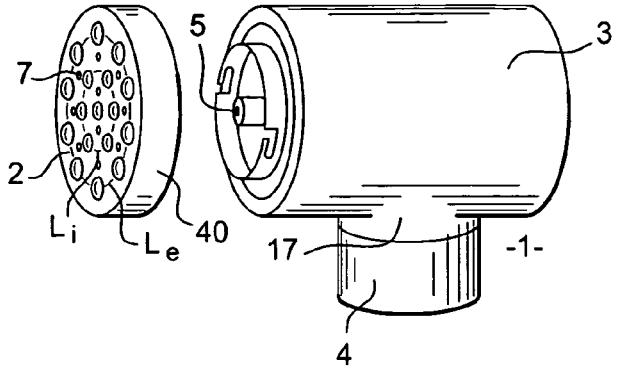
FIG. 1 is a partially exploded profile or perspective view of an appliance or device according to the invention.

FIG. 1 shows an example of an appliance or device 1 according to the invention in which a massage element 2 is detached from a housing 3 to which is mounted a container 4 designed to dispense the product P contained therein through the massage element 2 via at least one conduit or channel 5. In the illustrated example, the conduit 5 emerges at or is in communication with an application surface 6 of this massage element 2 through at least one outlet aperture 7 of the massaging element 2.

The container 4 is a device designed to contain and to dispense under pressure a product P, for example, in liquid or paste form. The container 4 is preferably an "aerosol." Such a container 4 serves to propel the product P into the conduit or channel 5 and through the massage element 2.

The container 4 includes an outer rigid chamber 8, preferably made of metal or plastic. In the illustrated example, the container 4 also includes a dispensing valve 9 generally mounted on a cup 10 held in place, for example by rolling, on the outer chamber 8. In this example, the container 4 enables the product P to be dispensed continuously, at a continuous rate of flow, during the phase where the valve 9 is held open.

The chamber 8 can contain the product and the propellant gas. To dispense the product, when the stem 11 of the dispensing valve 9 is actuated, the valve 9 is continuously supplied with the product, for example by an immersion tube, if the density of the product to be dispensed is greater than that of the propellant gas and if the container is presented "upright," i.e. with the valve 9 above the chamber 8.

Figure 2:
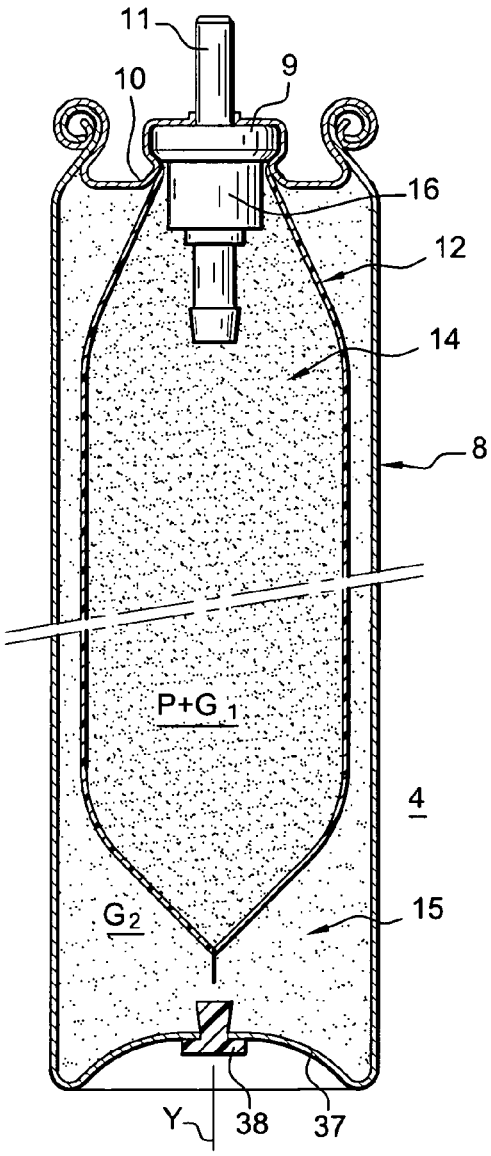
FIGS. 2 and 3 are lengthwise sectional views of containers configured to be mounted in an appliance or device according to the invention.
Figure 3:
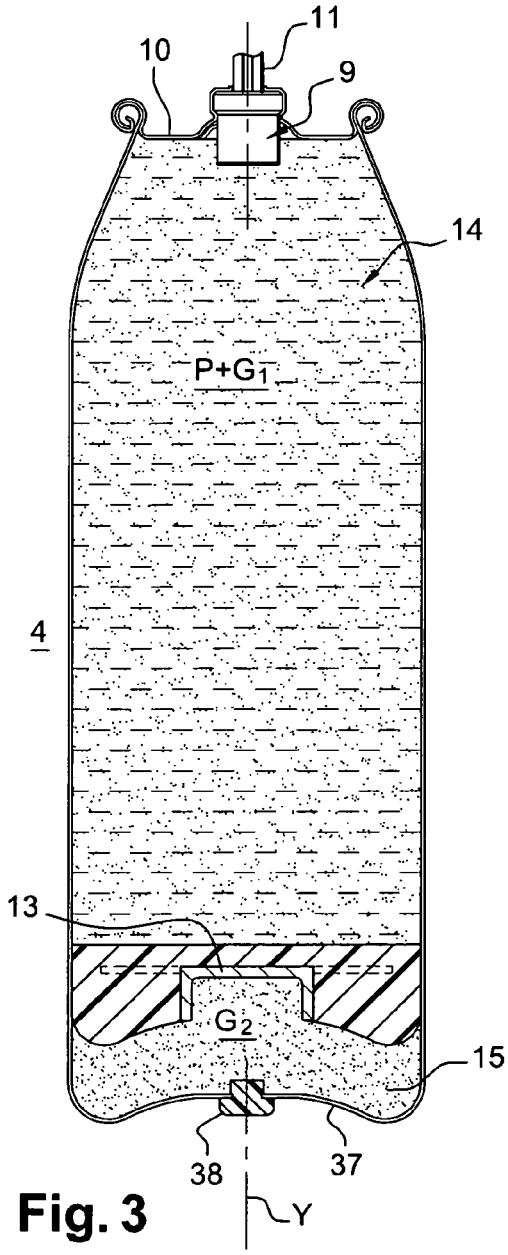

Also by way of example, in order to dispense the product in any position, the product P to be dispensed and the propellant gas can be packaged separately in the chamber 8 as shown in FIGS. 2 and 3, and the container 4 can then be of the type taught in document FR-2841159, for example.

As shown in the example of FIG. 2, the product can be packaged in a flexible-wall pocket 12 in communication with the dispensing valve 9. A propellant G2 is packaged in a volume formed between the external surface of the pocket 12 and the inner wall of the outer chamber 8. The internal volume of the pocket 12 defines a first compartment 14 and the volume of the chamber 8 outside the pocket 12 defines a second compartment 15.

Alternatively, as shown in the example of FIG. 3, the product P can be kept separate from the propellant gas G2 by means of a piston 13 designed to slide in leaktight bearing contact against the inner surface of the outer chamber 8 so that the container 4 is separated into two compartments, a first compartment 14 in communication with the dispensing valve 9, containing the product P, and a second compartment 15 between the piston 13 and the bottom of the container, holding the propellant gas G2.

To dispense the product with such devices, the dispensing valve 9 is caused to open by depressing and/or by tilting the stem 11 projecting beyond the body 16 of the valve 9. The body 16 of the valve 9 is in a fixed axial position relative to the outer chamber 8 by virtue of the fact that it is held in place in the cup 10, for example by crimping, with the cup 10 also being in a fixed axial position relative to the chamber 8.

When the dispensing valve 9 is opened, the pressure exerted by the propellant agent G2 on the pocket 12 or the piston 13 acts upon and expels the product P from the pocket or the first compartment via the dispensing valve 9.

The product P can then be dispensed, for example, in paste form, in particular a cream or gel, in liquid form, spray form, or in the form of a foam.

In the first compartment 14 or internal volume of the pocket 12, the product P to be sprayed can be mixed with a first propellant G1 or a high vapor pressure solvent, while the second compartment 15 contains the second propellant G2. In this example, the wall of the pocket 12 or of the piston 13 is impermeable to the product and to the propellants in the illustrated arrangements.

The first propellant G1 is chosen, for example, from hydrocarbons or dimethylether, alone or mixed. The second propellant G2 is, for example, a compressed or liquefied gas, for example a mixture of propane, butane and isobutane, or compressed air.

The pocket 12 can be made of a metal-plastic composite, for example an aluminium-plastic composite including a layer of aluminium and at least one layer of a thermoplastic material, in particular a polyamide, a polyethylene, a polyethylene terephthalate or a polypropylene.

The container 4 is preferably designed to be detachably mounted in the housing 3. It is designed, for example, to be held in place by a snap-on attachment with counterpart means provided on the inner surface of a cavity 17 formed in the housing 3, as shown by way of example in FIG. 4. In particular, the snap-on arrangement associated with the cavity can cooperate with an annular bead formed by the junction zone between the cup 10 and the outer chamber 8. As a variant, the container 4 can be held in place by force fitting in the cavity 17, for example.

Furthermore, as shown in FIG. 1, the massage element 2 forms a detachable head 40, and is designed, for example, to be held in place by a bayonet type mount on a support 41. Alternatively, the head 40 can be held in place by snapping onto the support 41. As a variant, as shown in FIGS. 4 to 9, the head 40 is integral with the support 41, for example by gluing or thermo welding.

Figure 4:
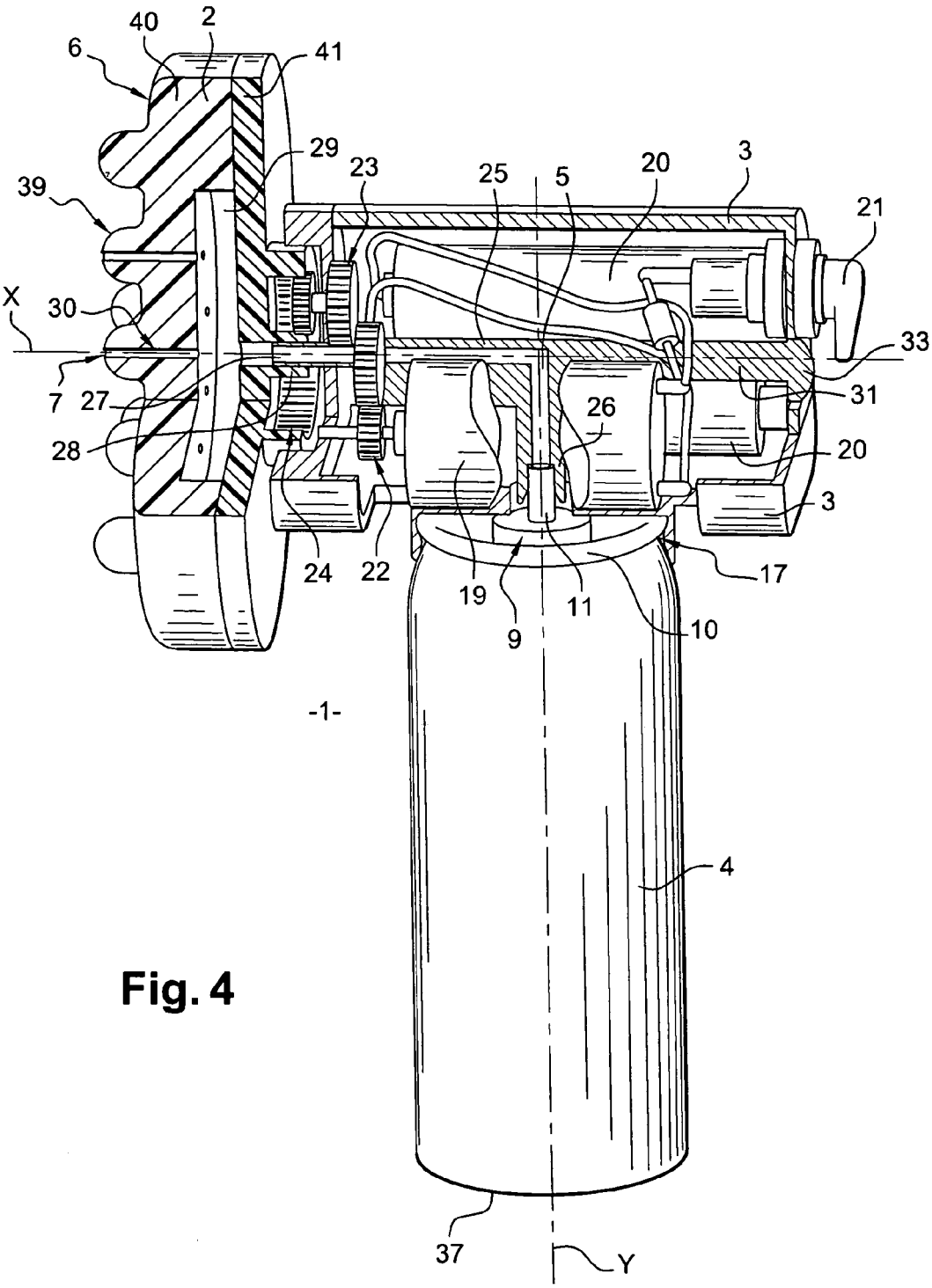
FIG. 4 is a partially truncated profile view of an appliance according to the invention.

The massage element 2 is designed to be driven in rotation relative to the housing 3 by a driving arrangement provided inside the housing 3, as shown for example in FIG. 4. The driving arrangement in this example includes a motor 19 powered by a battery 20, with the battery 20 being connected to a control device 21. The control device selectively switches the power supply to the motor 19 on or off, and thereby can start or stop the rotation of the massaging element 2. The battery 20 is formed by at least one cell, or several cells, accommodated in the housing 3. Alternatively, the motor 19 can be powered by another power source external to the housing, for example using a cord and plug to couple the device to an electrical power outlet.

The control device 21 can optionally facilitate selection of different rotational speeds of the motor 19. The control device 21 can form an electrical switch fitted with a rotary selector projecting from the housing 3, for example so that it can be placed respectively in three positions: a first "off" position, a second position corresponding to a first rotational speed, and a third position corresponding to a second rotational speed. Also by way of example, the control device 21 can include a continuously variable speed drive to regulate the rotational speed of the motor 19 to obtain finer control of the massaging action desired, and in particular depending on the massaging element 2 fitted and/or the surface of skin to be massaged.

The motor 19 rotationally drives a toothed wheel 22 cooperating with a set of gears 23 transmitting the movement to the massage element 2. In effect, the massage element 2, and more particularly the support 41, includes a toothed surface 24 engaging with one of the gears of the gear system 23. The gear system 23 provides an arrangement for reducing the rotational speed of the massaging element, with this reducing gear system or arrangement 23 making it possible to increase the torque.

The toothed surface 24 is annular and traversed through its center by the channel 5. The channel 5 is partly formed inside a tube 25, disposed in the housing 3, a first end 26 of which is connected to the end of the valve stem 11 through which the product P is dispensed. At a second end 27, the tube 25 is engaged with a mounting skirt 28 of the massaging element 2, and more particularly of the support 41. This mounting skirt 28 is inside and concentric with the toothed surface 24, and is in fluid communication with the outlet aperture 7. In effect, the mounting skirt 28 emerges into an internal space 29 of the massaging element 2 in the illustrated example, with this internal space 29 being for example formed between the support 41 and the head 40, so that the application surface 6 is traversed by at least one feeder channel 30 connecting the internal space 29 to the outlet aperture 7. As shown in FIG. 4, the application surface 6 is traversed by a plurality of feeder channels such as 30 emerging into the internal space 29 on one hand, and via a corresponding number of outlet apertures such as 7 on the other hand.

The axis X about which the massaging element 2 is rotationally driven preferably corresponds to the axis of symmetry of revolution of the inner surface of the mounting skirt 28 and the outer circumference of the tube portion 25 situated between the ends 26 and 27. Between the ends 26 and 27, the channel 5 forms a first section extending on the axis of rotation X.

When the massage element 2 is driven in rotation, the mounting skirt 28 is driven in rotation relative to the tube 25 which remains rotationally immobile relative to the housing 3. To this end, an annular ring can be provided between the tube 25 and the skirt 28 to maintain the leaktightness of this connection even when one is driven rotationally relative to the other.

The appliance 1 is designed so that dispensing of the product P can be obtained independently of the rotationally driven action of the massage element 2. For this purpose, and preferably in proximity to the control device 21, the appliance 1 includes an actuating element 33 of the valve 9 projecting beyond the external outline of the housing 3. This actuating element 33 projects from the housing 3 and can be moved relative to the housing 3 so as to exert a pressure on the valve stem 11 and thereby facilitate the dispensing of product P into the channel 5.

In this example, according to the embodiment depicted in FIG. 4, the valve 9 can be opened by tilting the valve stem 11 relative to a lengthwise axis of the body 16 of the valve 9. This lengthwise axis is preferably superimposed on a principal lengthwise axis Y of the container 4, and the container 4 is mounted in the housing such that the principal lengthwise axis Y forms an angle with the axis of rotation X.

The tube 25 is therefore mounted on the stem 11 so that together they form a non-zero angle, in this example 90°. Thus, actuation of the stem 11 can be obtained by a simple translational movement of the tube 25 along the axis X. This translational movement can be obtained in a direct manner, as shown, insofar as the tube 25 includes a portion extending along the axis X and emerging from the housing 3, with this portion of axis X extending opposite the tube portion wherein the channel 5 is partly formed. An end 31 of the portion extending along the axis X projecting beyond the housing 3 then forms the actuating element 33.

Alternatively, a system can be provided, for example, with a lever arm to move the stem 11 relative to the axis Y, with this lever arm being disposed in the housing 3 between the actuating element 31 and the stem 11.

Figure 5:
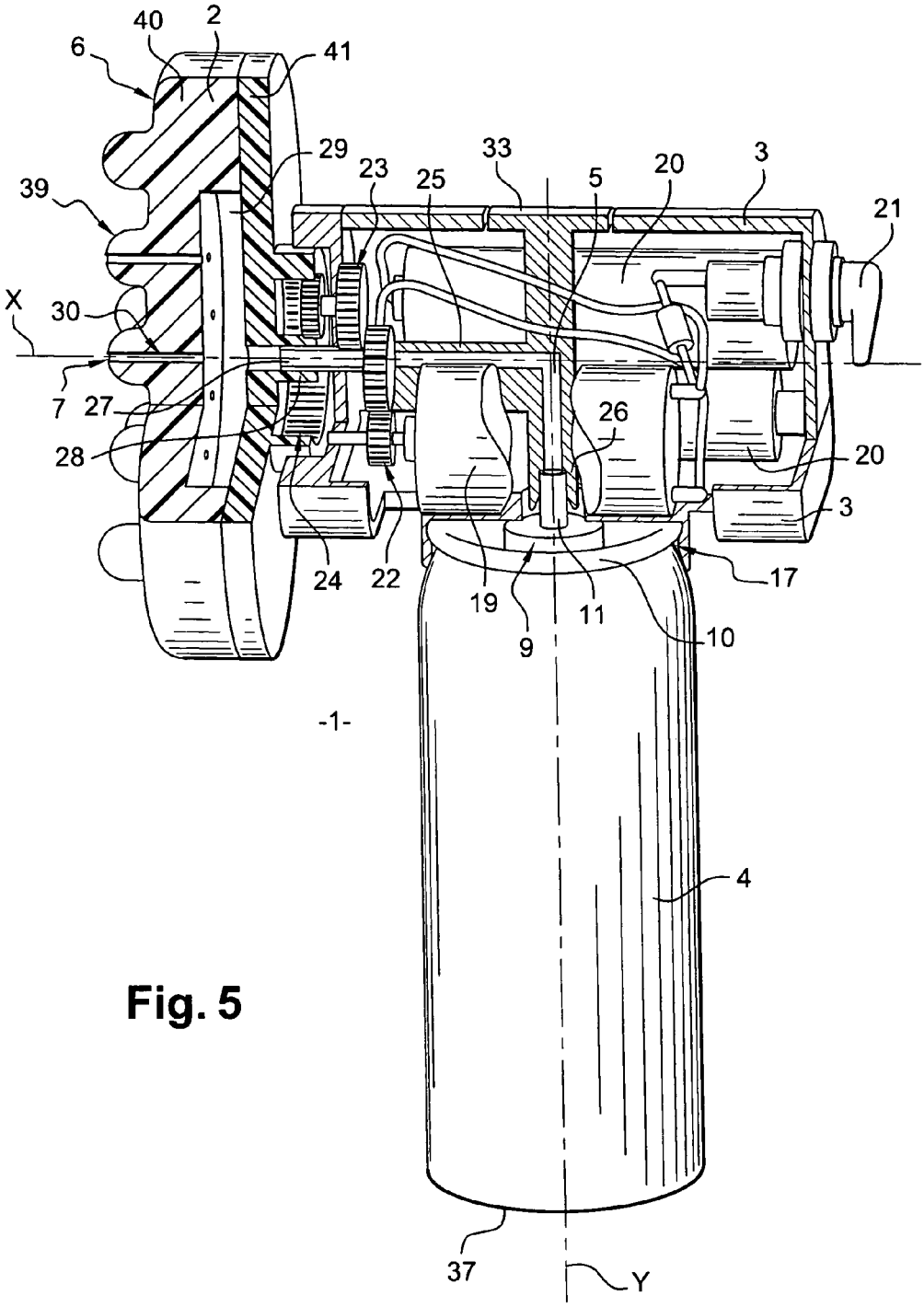
FIG. 5 is a partially truncated profile view of another embodiment of an appliance according to the invention.

In an alternative embodiment of an appliance according to FIG. 4, depicted in FIG. 5, opening of the valve is obtained by pressing down the valve stem 11 relative to the valve body 16. In this example, a push button 33 is provided on the outer surface of the housing 3, disposed on the lengthwise axis Y of the container 4. Thus, actuation of the valve 9 is obtained by pressing the push button 33 in the housing 3 along the axis Y. The push button 33 extends inside the housing so as to be capable of transmitting its downward movement respectively to the end 26 of the tube 25 and de facto to the valve stem 11 inside said housing 3 with the container 4 being held in a fixed axial position in the housing 3, when the push button 33 is depressed, the valve 9 then releases product into the channel 5.

Figure 6:
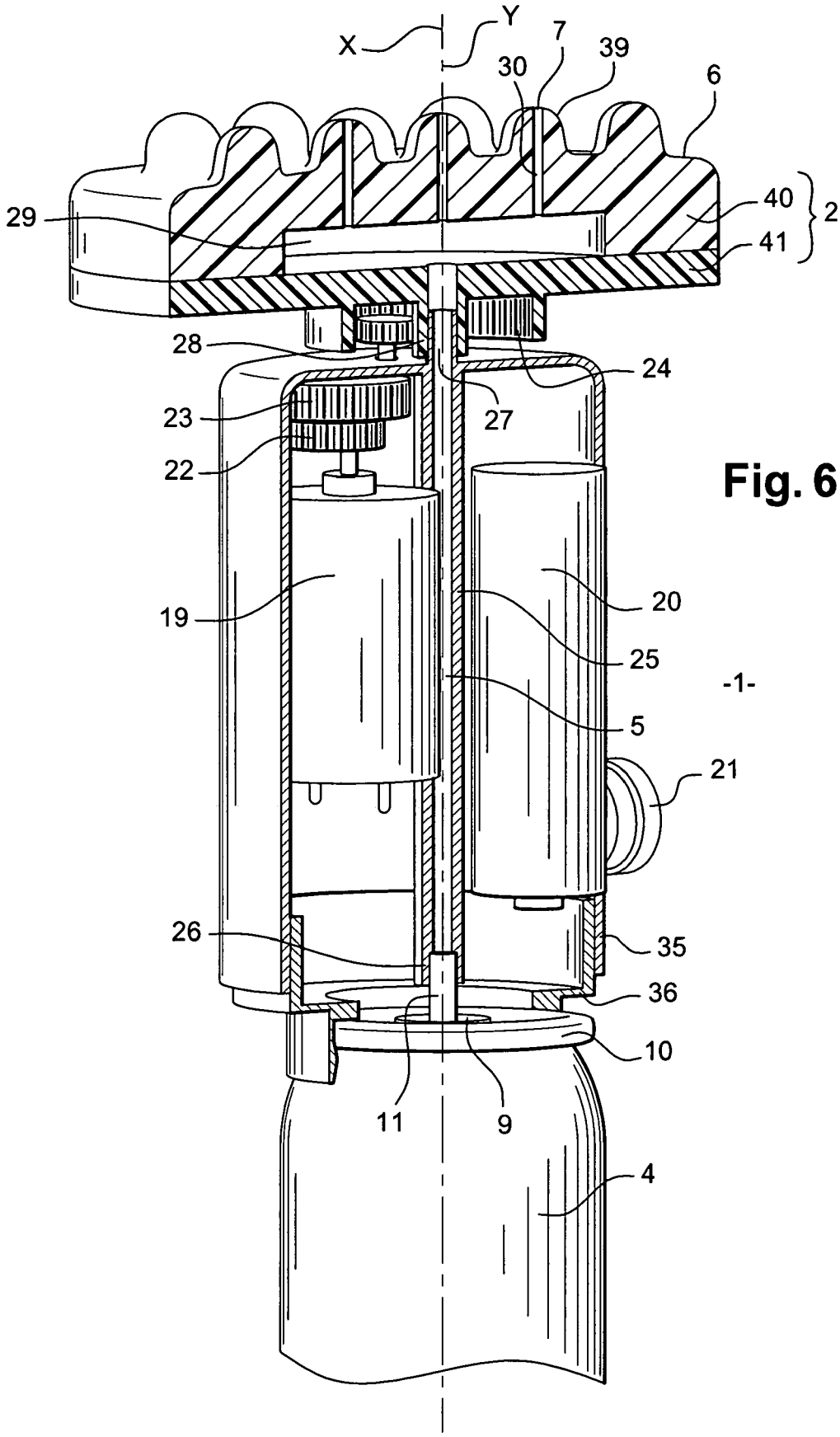
FIG. 6 is a partially truncated profile view of still another example of an appliance according to the invention.

In another alternative embodiment of an appliance 1 according to the invention, for example as depicted in FIG. 6, the axes X and Y can be mutually parallel. The container 4 is then held in place at an end of the housing axially opposite the end at which the massaging element 2 is mounted. In this example, actuation of the valve 9 is obtained by pressing downward, and this downward movement is obtained in particular by relative movement of the container 4 in relation to the housing 3, insofar as the tube 25 in this instance is in a fixed axial position inside the housing 3.

To dispense the product with such an appliance 1, the user grasps the outer surface of the housing with one hand and the outer surface of the container 4 with the other hand, and pushes them together. Alternatively, the user can apply the application surface 6 against an area of the skin to be treated and then, depending on the grasping zone chosen, he/she can selectively dispense product or otherwise. In effect, if the user grasps the outer surface of the housing 3 when the application surface 6 is applied against the skin, the container 4 then remains in a fixed axial position relative to the housing 3, and the valve 9 remains closed. There is no dispensing of product.

However, if the user grasps the outer surface of the container 4, the container 4 can be depressed partially into the cavity 17 of the housing 3, and the valve 9 can be caused to open allowing the product to be dispensed, in relation to the force with which the application surface 6 of the appliance 1 is applied against the skin.

In this embodiment, the control device 21 is designed to project beyond a sidewall 35 of the housing 3.

When the user grasps the container 4 by its outer surface projecting beyond the housing 3, and to ensure that only a translational movement of the container 4 relative to the housing 3 is permitted, the container 4 is fitted with a collar 36 to guide and optionally limit the movement of the container 4 relative to the housing 3. This collar 36 cooperates with the sidewall 35.

Figure 8:
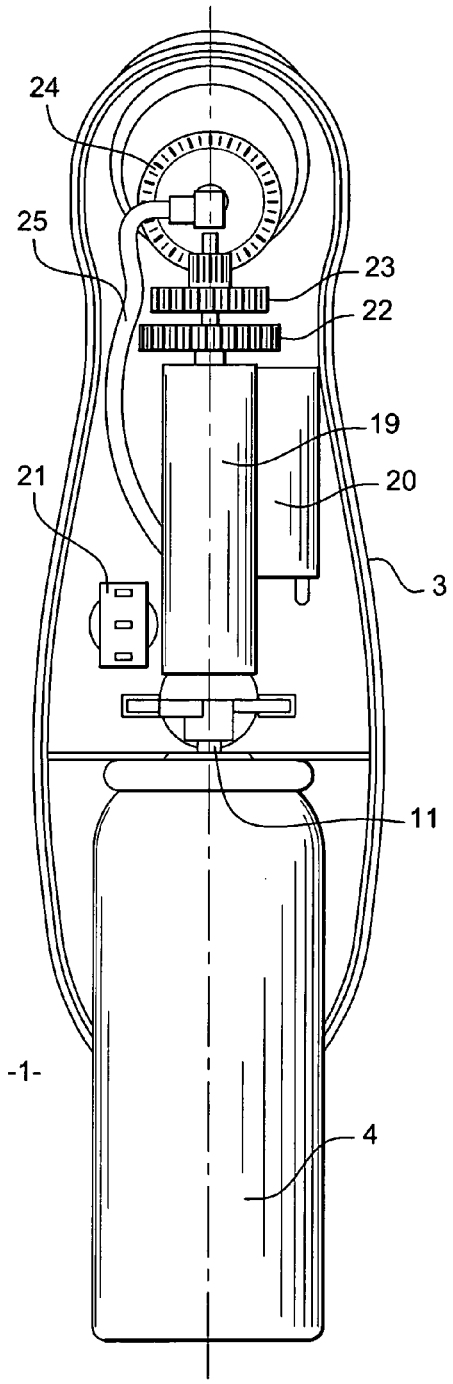
FIGS. 8 and 9 are a partially truncated profile view and a sectional view of another embodiment of an appliance according to the invention.
Figure 9:
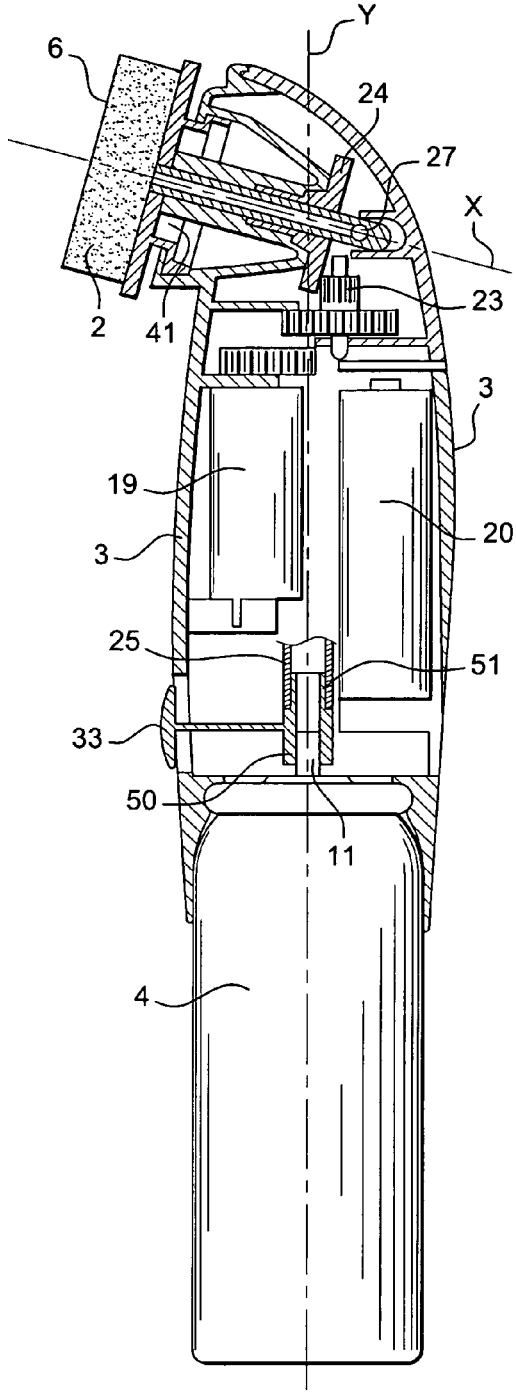

In another alternative embodiment of an appliance 1 according to the invention depicted, for example, in FIGS. 8 and 9, the axis of rotation X of the massaging element 2 is inclined relative to the principal lengthwise axis Y of the container 4. The axis X is, for example, inclined at an angle of 75° relative to the axis Y.

In this variant, the housing 3 includes an outer enclosure forming a shell which partly covers the container 4. In the illustrated example, the actuating element 33 is a separate component from the housing. The actuating element can include a portion that is situated outside the housing and which can be moved on an axis perpendicular to the axis of the valve stem to cause the valve stem 11 to tilt. To actuate the valve stem, the actuating element 33 is mounted on the valve stem 11 via a first skirt 50 which fits over the valve stem 11. The actuating element 33 includes a second skirt 51, which communicates with the first, and over which is fitted the tube 25 connected the valve stem 11 to the massage element 2, so as to place the valve stem 11 in fluid communication with the tube 25.

In this embodiment, the tube 25 is flexible. It can then pass around the different parts of the appliance contained in the housing 3.

By using a component separate from the housing 3 to form the actuating element 33, it is possible to use different materials to form the housing and the actuating element. Given that the product flows inside the two skirts 50 and 51 of the actuating element 33, the latter must be made of a material compatible with the product. However, as the product is not in contact with the housing 3, it is not necessary to use a material compatible with the product to make the housing, which leaves a wider choice in terms of the materials that can be used. The housing 3 can, for example, be made with materials that contribute to enhancing the aesthetic appearance of the appliance.

In this variant, the container which is fixed on the housing by snap attachment is also detachable.

By way of example, in the different embodiments, FIGS. 4 to 9, the sidewall 35 of the container 4 is preferably cylindrical, with the container 4 including a bottom 37 axially opposed, relative to the axis Y, to the cup 10 carrying the valve 9. The bottom 37 is closed. It optionally includes a plug 38 to facilitate pressurisation of the second compartment 15 when the propellant G2 is injected via a syringe or needle through this plug 38, as shown in FIGS. 2 and 3.

Also by way of example, in the embodiments of the invention, the bottom 37 and at least one portion of the sidewall 35 project beyond the housing 3. For example, the portion of the sidewall 35 projecting beyond the housing 3 accounts for more than half of said sidewall 35 relative to the principal lengthwise axis Y. Thus the bottom 37 and the portion of the sidewall 35 provide an arrangement grasping the appliance 1.

Furthermore, this visible portion of the container 4, not concealed by the housing 3, when the container 4 is mounted in the housing 3, enables the user, for example, to peruse information relating to the product and/or recommended instructions for use which may be inscribed on the sidewall 35.

Figure 7:
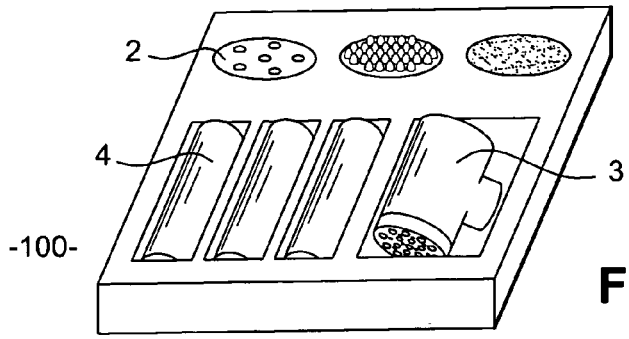
FIG. 7 is a perspective view of a kit according to the invention.

For example, it is useful to understand a method of using this appliance 1 when the appliance 1 is not fully assembled and ready to use, such as when it is supplied in the form of a kit 100, as shown in the example illustrated in FIG. 7. This arrangement optionally includes several massage elements such as 2 having different application surfaces capable of being selectively and detachably mounted on the housing 3, and includes several containers such as 4 holding different products, with the containers being capable of selective and detachable mounting on the housing 3.

A method of applying a product on a surface of the body to be treated using the appliance 1 can include selecting a massage element such as 2 according to the product held in the container 4 that has been selected, mounting this massage element on the housing 3, and moving the valve 9 to the open position so that product is dispensed at the application surface 6 so as to be applied on the body. Then, simultaneously or otherwise with the dispensing of the product, the user can massage the area of the body where the product has been applied using the rotationally driven massaging element.

In particular, the massage elements designed to be mounted on the housing 3 so as to be rotationally driven, can have different application surfaces such as 6. They can present projections and/or a surface texture enabling the user to massage and/or cleanse the skin.

The application surfaces such as 6 of the massaging elements can be based on natural or synthetic fibres (woven, non-woven, wadding, etc.), natural or synthetic sponge, or can be made of several materials. The massage elements can also be impregnated with a second product, for example having antibacterial or coloring properties.

In the embodiment shown, the application surface 6 is formed from a block of thermo-compressed foam optionally covered with a textile, presenting projections 39 disposed in a regular manner over the entire application surface 6. For example, they can be arranged in two circular concentric lines $L_e$ and $L_i$ centered on the axis of rotation X. Such an applicator element is obtained, for example, in accordance with the teaching of patents FR-2 674 183 and FR-2 811 872. Some of the projections can be traversed by a channel such as 30. Particularly in cases where the application surface 6 is supplied by several channels such as 30, the latter may also emerge at a distance from the projections such as 39. In this example, the projections such as 39 form dome-shaped bosses.

By way of example, the application surface 6 of the massaging element can have a symmetry of revolution substantially about an axis of symmetry superimposable on the axis of rotation X.

Figure 10A:
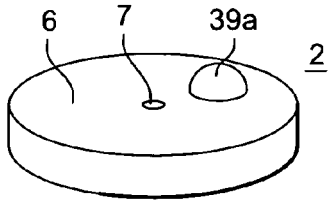
FIGS. 10*a* to 10*e* are views of different application surfaces of massage elements that can be mounted in an appliance according to the invention.

As a variant, the application surface 6 can have a single projection such as 39*a* placed off-center relative to the axis of rotation X when the massaging element 2 is mounted on the housing 3, as shown in the example of FIG. 10*a*.

Figure 10B:
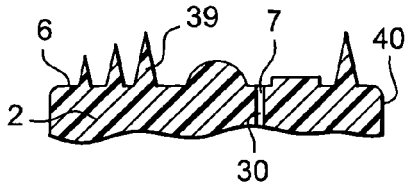

As a variant, the application surface 6 includes a plurality of projections such as 39 of different shapes and different heights, as shown in FIG. 10*b*.

Figure 10C:
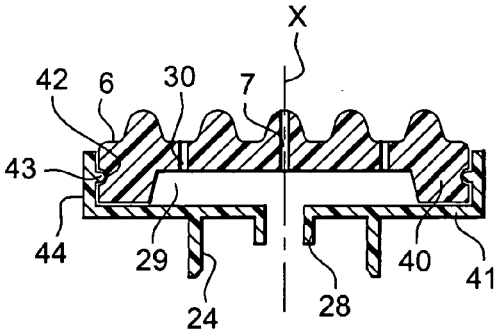

In FIG. 10*c*, the application surface 6 can be presented on the head 40 detachable from the support 41 designed to be retained on the housing 3, with the support 41 and the head 40 together forming the massage element 2 capable of being rotationally driven. Heads such as 40 designed to be mounted on the support 41 can respectively have different application surfaces. In this example, the head 40 includes a groove 42 designed to engage by snap attachment with a groove 43 on an inner surface of a skirt 44 of said support 41. The skirt 44 extends in a direction opposite the mounting skirt 28.

This head 40 can be made of foam, or a resiliently deformable material, in particular an elastomer, for example a PVC, PU, EVA, Nitrile, Silicone, Butyl, SIS, SEBS, EPDM, etc.

Preferably, the application surface 6 includes a resiliently deformable portion, for example made of an elastomer, to impart a feeling of comfort when applied on the skin. It can be made at least partially of resiliently deformable material such as PVC, PU, EVA, Nitrile, Silicone, Butyl, SIS, SEBS, EPDM, etc.

Figure 10D:
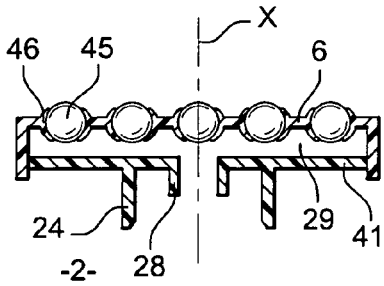

As a variant, shown for example in FIG. 10*d*, the massage element 2 can include a structure holding freely rotatable balls 45 each respectively seated in recesses 46 on the application surface 6 of the massage element 2.

Figure 10E:
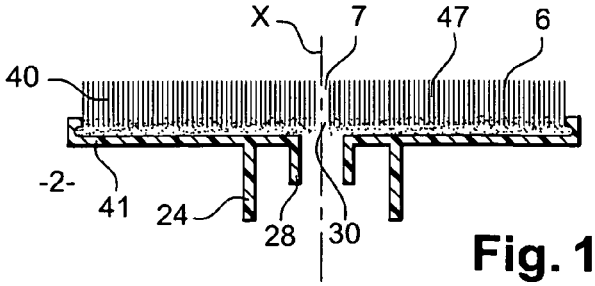

Alternatively, as shown for example in FIG. 10*e*, the application surface 6 can include a tuft of bristles 47 designed to be applied against the area of skin to be massaged. The massage element can then be used in the manner of a shaving brush to work up a foam with the product spread on the face before shaving.

As a variant, when the purpose of the massage is to deep cleanse the skin, the application surface 6 can be abrasive, obtained for example by incorporating particles of aluminium oxide in a resin or a foam.

Throughout the description, expressions such as "including one" or having one, etc., should be regarded as synonymous with "including at least one," unless otherwise specified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for massaging and/or dispensing a product comprising:

an aerosol container that holds a cosmetic product;

a housing to which the container is detachably mounted;

a massage element mounted on the housing;

a rotary driving arrangement which rotates the massage element relative to the housing about an axis of rotation of the massage element; and a conduit in fluid communication between an outlet of the container and an outlet of the massage element, wherein the container is configured for packaging and dispensing of the product under pressure, and wherein the conduit is connected to an outlet of a dispensing valve on the container.

2. A device according to claim 1, wherein the container is arranged relative to the housing so as to form a grasping element.

3. A device according to claim 1, further including an actuating element which actuates the valve, wherein the actuating element projects beyond an external outline of the housing.

4. A device according to claim 3, wherein the actuating element includes a lever arm.

5. A device according to claim 1, further including means for actuating the valve by pushing down a valve stem.

6. A device according to claim 1, further including means for actuating the valve by tilting a valve stem.

7. A device according to claim 1, wherein the conduit includes a section parallel to the axis of rotation.

8. A device according to claim 7, wherein the conduit includes a section having an axis substantially coincident with the axis of rotation.

9. A device according to claim 1, wherein the axis of rotation extends at a non-zero angle with a principal lengthwise axis of the container.

10. A device according to claim 1, wherein the container includes a principal lengthwise axis parallel to the axis of rotation.

11. A device according to claim 1, wherein the container is mounted on the housing at a first end axially opposite, relative to the axis of rotation of the massage element, a second end of the housing where the massage element is held, such that the container includes an axis extending between said outlet and a bottom of the container, with said axis of said container being parallel to the axis of rotation.

12. A device according to claim 1, wherein the container is snap-fit into a cavity of the housing.

13. A device according to claim 1, wherein the container includes a wall delineating therein two compartments having variable volumes, the two compartments including a first compartment in communication with the valve and containing the product to be dispensed and a second compartment containing a propellant, and wherein the wall is impermeable to the product and the propellant.

14. A device according to claim 1, wherein the massage element is detachably mounted on the housing.

15. A device according to claim 1, wherein the massage element includes an application surface having at least one projection which is off-center with respect to said axis of rotation.

16. A device according to claim 1, wherein the massage element includes an application surface which includes a plurality of projections having different shapes and different heights.

17. A device according to claim 1, wherein the massage element includes a detachable head having an application surface thereon.

18. A device according to claim 1, wherein the massaging element includes a foam pad arranged to be applied against an area of the skin to be massaged.

19. A device according to claim 1, wherein the massage element includes a tuft of bristles.

20. A device according to claim 1, wherein the massage element includes a structure holding freely rotatable balls seated in recesses in the massage element.

21. A device according to claim 1, wherein the massage element includes a resiliently deformable portion.

22. A device according to claim 1, wherein the massage element includes an abrasive application surface.

23. A device according to claim 22, wherein the abrasive application surface includes particles of aluminium oxide in a resin.

24. A device according to claim 1, wherein an application surface of the massage element is symmetrical about an axis of symmetry, and wherein the application surface is caused to rotate by the driving arrangement about said axis of symmetry.

25. A device according to claim 1, wherein the driving arrangement includes a motor.

26. A device according to claim 25, wherein the motor is powered by a battery.

27. A device according to claim 26, wherein the battery includes a cell accommodated in the housing.

28. A device according to claim 25, wherein the motor is powered by a power supply external to said housing.

29. A device according to claim 25, wherein the motor rotationally drives the massage element indirectly via a plurality of transmission elements.

30. A massage element rotatably and detachably mounted on a housing of a device as claimed in claim 1.

31. An assembly including: a device as defined in claim 1, wherein, a plurality of containers are provided, said containers being selectively and detachably mounted on the housing.

32. An assembly according to claim 31, wherein the containers respectively hold different products.

33. An assembly according to claim 31, wherein a plurality of massage elements are provided, and wherein said massage elements are selectively and detachably mounted on the housing.

34. A device according to claim 1, wherein the conduit includes a first section coincident with the axis of rotation and a second section perpendicular with the axis of rotation.

35. A device according to claim 1, wherein the conduit extends through the housing from a first end connected to the outlet of the container to a second end that projects beyond the housing into a mounting skirt of the massage element so as to create fluid communication between the outlet of the container and an interior of the mounting skirt.

36. A device according to claim 1, wherein the conduit is rotationally immobile relative to the housing.

37. A device according to claim 1, wherein the container is held in place by a snap-on attachment with counterpart means provided on an inner surface of a cavity formed in the housing.

38. A device according to claim 1, wherein the container is disposed substantially on an outside of the device.

39. A method of applying a cosmetic product on a surface of the body, comprising:

providing an assembly which includes a plurality of aerosol containers each holding a cosmetic product, a housing to which the containers are selectively and detachably mounted, a massage element mounted on the housing, a rotary driving arrangement which rotates the massage element relative to the housing, a conduit in fluid communication between an outlet of the container and an outlet of the massage element, wherein the containers are configured for the packaging and dispensing of the products under pressure, and wherein when a container is mounted on the housing the conduit is connected to an outlet of a dispensing valve of the container;

selecting a container from said plurality of containers;

detachably mounting the selected container on the housing;

applying a product from the selected container onto the body; and massaging the area of the body onto which the product has been applied with the massage element driven in rotation.

40. A method according to claim 39, further including providing a plurality of said massage elements, which are selectively and detachably mountable upon the housing, and selecting a massage element based on the container selected.

41. A method according to claim 39, wherein the container is arranged relative to the housing so as to form a grasping element.

42. A method according to claim 39, wherein the product is applied by an actuating element which actuates a valve of the container, the actuating element projecting beyond an external outline of the housing.

43. A method according to claim 39, wherein the container is snap-fit into a cavity of the housing.

44. A method according to claim 39, wherein the container is held in place by a snap-on attachment with counterpart means provided on an inner surface of a cavity formed in the housing.

45. A method according to claim 39, wherein the container is disposed substantially on an outside of the assembly.

* * * * *